US005918801A

United States Patent [19]

Milio

[11] Patent Number: 5,918,801

[45] Date of Patent: Jul. 6, 1999

[54] SHIPPING CASE

[75] Inventor: Ronald Milio, Baltimore, Md.

[73] Assignee: Lever Brothers Company, a division of Conopco, Inc., New York, N.Y.

[21] Appl. No.: 08/352,978

[22] Filed: Dec. 9, 1994

Related U.S. Application Data

[63] Continuation of application No. 08/017,073, Feb. 12, 1993, abandoned.

[51] Int. Cl.[6] ..... B65D 5/54

[52] U.S. Cl. ..... 229/237; 229/240; 229/242; 229/243

[58] Field of Search ..... 206/45.12; 229/237, 229/229, 240, 242, 243, 244

[56] References Cited

U.S. PATENT DOCUMENTS

| | | | |
|---|---|---|---|
| 1,455,792 | 5/1923 | Kessler . | |
| 1,479,018 | 1/1924 | Warren . | |
| 1,524,880 | 2/1925 | Rippenbein . | |
| 1,868,174 | 7/1932 | Reichel . | |
| 1,880,888 | 10/1932 | Dixn . | |
| 2,126,106 | 8/1938 | Goldberg . | |
| 2,747,788 | 5/1956 | Tilly | 227/244 X |
| 2,753,104 | 7/1956 | Wagner, Jr. | 229/244 |
| 2,822,917 | 2/1958 | Toensmeier . | |
| 3,078,028 | 2/1963 | Skowronski . | |
| 3,315,875 | 4/1967 | Praetorius | 229/244 X |
| 3,337,032 | 8/1967 | Ebelhardt . | |
| 3,357,542 | 12/1967 | Aquino et al. | 229/230 X |
| 3,399,820 | 9/1968 | Foster et al. . | |
| 3,481,454 | 12/1969 | King . | |
| 3,653,495 | 4/1972 | Gray | 206/45.12 |
| 3,669,251 | 6/1972 | Phillips, Jr. | 206/45.12 X |
| 3,685,775 | 8/1972 | Fortunato . | |
| 3,869,077 | 3/1975 | Tuura . | |
| 3,870,221 | 3/1975 | Zeitter . | |
| 3,918,584 | 11/1975 | Richardson . | |
| 3,973,721 | 8/1976 | Nakane . | |
| 4,062,486 | 12/1977 | Goodrich | 229/223 |
| 4,252,236 | 2/1981 | Roccaforte . | |
| 4,331,289 | 5/1982 | Killy . | |
| 4,382,504 | 5/1983 | Vesborg . | |
| 4,537,344 | 8/1985 | Thomas | 229/939 X |
| 4,550,834 | 11/1985 | Fletcher . | |
| 4,634,007 | 1/1987 | Rusrock | 229/237 X |
| 4,676,430 | 6/1987 | Wischusen, III et al. | 229/242 X |
| 4,714,191 | 12/1987 | Richardson . | |
| 4,860,886 | 8/1989 | Northrup et al. | 229/229 X |
| 4,865,187 | 9/1989 | Zulauf . | |
| 4,905,834 | 3/1990 | Mur Gimeno . | |
| 4,907,693 | 3/1990 | Child . | |
| 4,953,782 | 9/1990 | Noland | 229/939 X |
| 5,076,439 | 12/1991 | Kuchenbecker . | |
| 5,083,667 | 1/1992 | Holder | 229/237 X |
| 5,156,276 | 10/1992 | Lebowitz . | |

*Primary Examiner*—Gary E. Elkins
*Attorney, Agent, or Firm*—Gerard J. McGowan, Jr.

[57] ABSTRACT

An improved display carton. The carton of the invention includes a front panel having lines of weakness extending from the top corners of the panel down to the scoreline defining the bottom of the front panel. Lines of weakness are also provided in one or more of the flaps defining the top of the carton. The flaps on the top of the carton do not completely close the carton so that a user may grasp the carton at the top and pull on the top panel to remove portions of the top and front panels and reveal the product within the case. A particularly advantageous feature of the invention,is the use of a cut in a scoreline to improve the compressive strength of the carton. The cut is made at the bottom of one or more columns of flutes at a point where the flute would otherwise bend due to the presence of a scoreline defining a fold. The cut causes a complete cut of the flute rather than folding; the complete cut results in an increase in compressive strength when compared to the folded flute. Advantageously, the cut is made at the bottom scoreline of the front panel at the points where the lines of weakness meet the bottom scoreline.

28 Claims, 1 Drawing Sheet

SHIPPING CASE

This is a continuation application of Ser. No. 08/017,073, filed Feb. 12, 1993, now abandoned.

BACKGROUND OF THE INVENTION

It has become more common to display goods such as household products in the cases in which they are shipped. This avoids the need to unpack the cases and place the products on shelves. It also provides an opportunity to place attractive advertising matter on the case where it will be seen by consumers at the point of purchase. However, this trend does require that the case be adapted to display the goods.

Ferreri et al. U.S. Pat. No. 4,946,042 discloses a shipping and display case.

Various patents disclosing cartons or cases with tear away panels or other display features have issued, including Roccaforte U.S. Pat. No. 4,252,236, Zulauf et al. U.S. Pat. No. 4,865,187, Fletcher et al. U.S. Pat. No. 4,550,834, Vesborg U.S. Pat. No. 4,382,504, Tuura U.S. Pat. No. 3,869,077, Zeitter U.S. Pat. No. 3,870,221, Ebelhardt U.S. Pat. No. 3,337,032, Goldber U.S. Pat. No. 2,126,106, Toensmeier U.S. Pat. No. 2,822,917, Skowronski U.S. Pat. No. 3,078,028, Warren U.S. Pat. No. 1,479,108, Rippensein U.S. Pat. No. 1,524,880, Reichel U.S. Pat. No. 1,868,174, Dixn U.S. Pat. No. 1,880,888 and Kessler U.S. Pat No. 1,455,792, Richardson U.S. Pat. No. 3,918,584 and Mur Gimeno et al. U.S. Pat. No. 4,905,834.

A problem which has occurred in cases and cartons in which cutouts have been made is that a loss of strength results from the cutting of one or more panels of the carton. Especially is this the case where the panel cut is a panel supporting the weight of the carton, like the front panel. This is true even of corrugated materials.

Nakane U.S. Pat. No. 3,973,721 discloses a corrugated packing case 5 shown in FIG. 2 as having exposed edges.

SUMMARY OF THE INVENTION

The invention is directed to an improved display carton. The carton of the invention includes a front panel having lines of weakness extending from the top corners of the panel down to the scoreline defining the bottom of the front panel. Lines of weakness are also provided in one or more of the flaps defining the top of the carton. The flaps on the top of the carton do not completely close the carton so that a user may grasp the carton at the top and pull on the top panel to remove portions of the top and front panels and reveal the product within the case.

A particularly advantageous feature of the invention, which may be used in the above-described case or in other cartons or cases, is the use of a cut in a scoreline to improve the compressive strength of the carton. The cut is made, at the bottom of one or more columns of flutes at a point where the flute would otherwise bend due to the presence of a scoreline defining a fold. The cut results in a complete cut of the flute rather than folding; the complete cut results in an increase in compressive strength when compared to the folded flute. Advantageously, the cut is made at the bottom scoreline of the front panel at the points where the lines of weakness meet the bottom scoreline.

For a more complete understanding of the above and other features and advantages of the invention, reference should be made to the following detailed description of preferred embodiments and to the accompanying drawings.

DETAILED DESCRIPTION OF THE INVENTION

Figure 1:
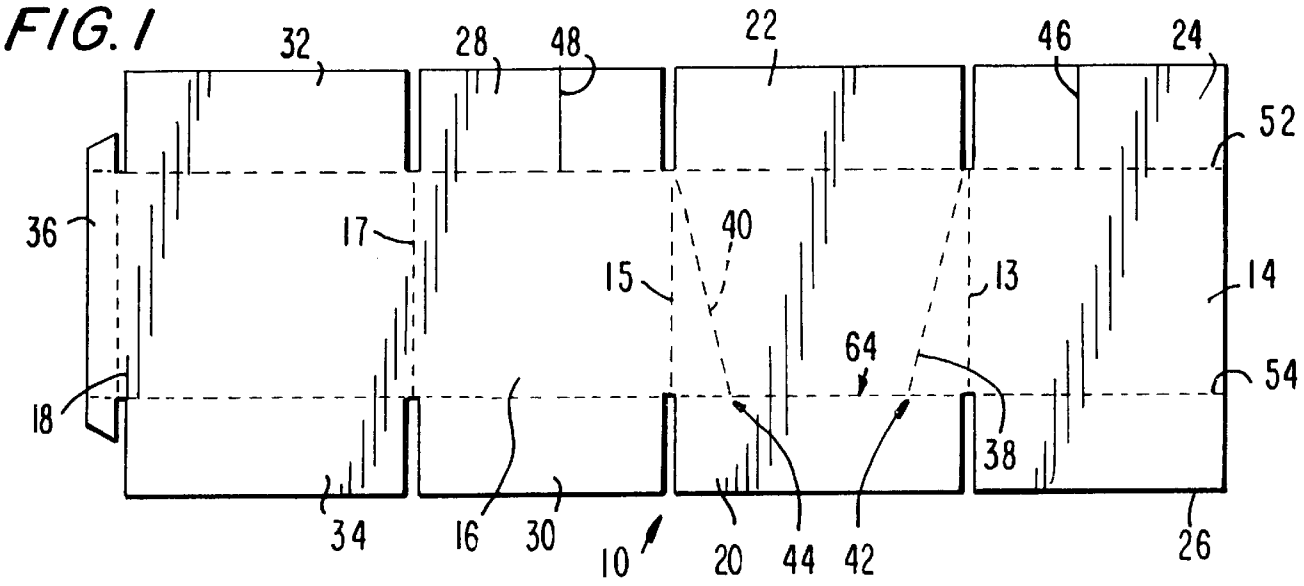
FIG. 1 is an inside plan view of a blank used to form the case of the invention.

As seen in present FIGS. 1 blank 10 is made of corrugated paperboard and comprises front panel 12, side panels 14 and 16 and rear panel 18. The panels are separated by score lines 13, 15, and 17. Glue flap 36 is separated from rear panel 18 by scoreline 19. Panels 14, 12, 16 and 18 include top flaps 24, 22, 28 and 32 and bottom flaps 26, 20, 30 and 34, respectively. The top flaps are separated from the panels by scoreline 52 and the bottom flaps are separated from the panels by scoreline. Scorelines 52 and 54 may be considered to be divided into separate scorelines by the scorelines separating the panels.

Top flaps 24 and 28 are provided with lines of weakness 46 and 48, respectively perpendicular to scoreline 52, for reasons which will be provided hereinbelow.

Front panel 12 includes perforations 38 and 40, or other lines of weakness, which may be perforations, partial cuts or the like. The perforations extend diagonally inward from the top corners of panel 12 to spaced points on score line 54. The perforations do not intersect. The portion of scoreline 54 between the points of intersections with the perforated lines are also weakened as by perforations or the like.

In accordance with a preferred aspect of the invention, at the points of intersection between perforated lines 38 and 44 and scoreline 54, small cuts 42, 44 are provided. The cuts may be, e.g., radial cuts or straight cuts, so long as they cut one or more of the flutes of the paperboard (not shown) in a manner which prevents the flute or flutes from folding at the scoreline. This increases the compressive strength of the case. In particular, the cuts shown in FIG. 1 increase the compressive strength of panel 12, particularly once it has been erected into the carton shown in FIG. 2.

Generally, the minimum length of the cut will correspond to the width of the flute. For instance, where the flutes are 3/16 inch in width, the cut will be at least 3/16 inch long so that the entire dimension of the flute transverse to its longitudinal axis is cut. If materials having smaller flutes is used, e.g., flutes of 1/8 inch width, the cut will be at least 1/8 inch long.

Figure 2:
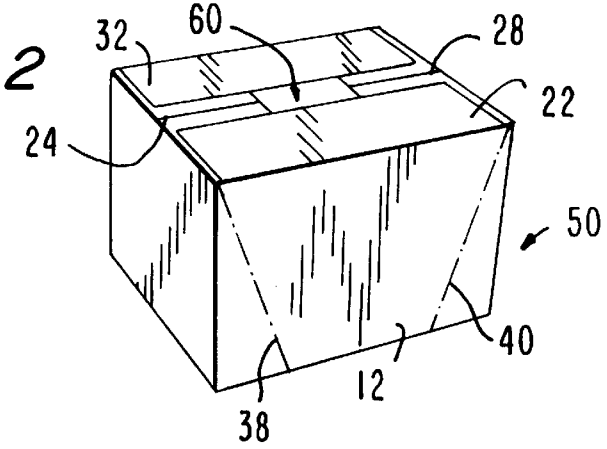
FIG. 2 is a perspective view of a case of the invention formed from the blank of FIG. 1.

As seen in FIG. 1, unlike lines 38 and 44, scoreline 54 is not perforated, other than the inclusion of small cuts 42, 44. The case is erected by folding the panels into a flattened tube and adhering glue flap 36 with suitable adhesive. Then, the top and bottom flaps are folded perpendicularly to from the top and bottom of the case 50, as seen in FIG. 2. Various of the top flaps and bottom flaps are adhered to each other to keep the carton closed. In particular, the underside of flap 22 will be adhered to aspects of flaps 24 and 28 on the sides of lines of weakness 46 and 48 closest to flap 22.

The case may be used to ship product, e.g., household products such as laundry detergents cartons or bottles, automatic dishwashing detergent cartons or bottles, fabric softener cartons or bottles, etc.. When it is desired to display the contents, the top flap 22 is grasped by inserting the user's hand through opening 60. Since the underside of flap 22 is adhered to flaps 24, 28, by pulling on flap 22, lines of weakness 46 and 48 are broken and approximately half of the top of the case is opened. Then, by pulling downwardly in flap 22, perforated lines 38 and 40 are severed. Finally, by pulling flap 22 away from the carton, the perforated lines 64 on the bottom scoreline of the front panel are severed, whereby the severed flaps and panels can be removed and a display carton is seen.

EXAMPLES

The case illustrated in FIG. 2 was compared with an identical case, except that it lacked the cuts 44, 42 according to the invention. The compressive strength was determined using ASTM Standard Test Method D642–76.

The results were as follows:

| | Compressive strength (lb./inches deflection) | |
|---|---|---|
| Trial | Carton of the Invention | Comparison Carton |
| 1 | 960/.41 | 860/.38 |
| 2 | 992/.38 | 866/.41 |
| 3 | 912/.36 | 850/.41 |
| 4 | 935/.40 | 844/.45 |
| Avg | 949.75 lb/0.39" defl | 855 lb/0.41" defl |

It will be apparent that the compressive strength of the case having the back cuts according to the invention had significantly greater compressive strength than the comparison case which lacked such cuts.

It should be understood, of course, that the specific forms of the invention herein illustrated and described are intended to be representative only as certain changes may be made therein without departing from the clear teachings of the disclosure. Accordingly, reference should be made following appended claims in determining the full scope of the invention.

What is claimed is:

1. A blank for forming a shipping case having a top and a bottom comprising a first panel made from corrugated paper having a column formed from a flute, said panel having a top disposed adjacent the top of said shipping case and a bottom disposed adjacent the bottom of said shipping case, a first scoreline substantially perpendicular to said flute at the bottom of said panel and one or more cuts at said scoreline at said flute at least at one side of the panel to improve the compressive strength of said panel, said cut or cuts extending outside of said scoreline, said first scoreline being not otherwise perforated.

2. The shipping case blank of claim 1 wherein said first panel further comprising lines of weakness defining, at least in part, a tear out section.

3. The shipping case blank of claim 2 wherein said first panel comprises a plurality of flutes having cuts to improve their compressive strength.

4. The shipping case blank of claim 1 wherein said first panel is a front panel.

5. The shipping case blank of claim 2 further comprising a first flap separated from said first panel by said first scoreline, said lines of weakness intersecting said first scoreline, and said cut occurring where said lines of weakness and said first scoreline intersect.

6. The shipping case blank of claim 5 further comprising a second flap separated from said first panel by a second scoreline on a side of said first panel opposite said first flap, said second flap having two ends perpendicular to said second scoreline, said lines of weakness extending from said second scoreline at said ends of said second flap to said first scoreline.

7. The shipping case blank of claim 6 further comprising second and third panels on opposite sides of said front panel and separated therefrom by first and second panel scorelines, said second and third panels constituting side panels, said panel scorelines being perpendicular to said first and second scorelines, and a fourth panel separated from one of said side panels by a third panel scoreline disposed perpendicularly to said first and second scorelines.

8. The shipping case blank of claim 7 wherein said second and third panels each include second and third side panel first and second flaps separated form said second and third panels by side panel flap scorelines perpendicular to the second and third panel scorelines.

9. The shipping case blank of claim 8 wherein said second flap of said first panel comprises a third end parallel to the scoreline separating said first panel from said second flap, said second flaps of said second and third side panels each including lines of weakness which line-up with said third end when said display carton is erected.

10. The shipping case blank of claim 9 wherein said first panel is a front panel, said second and third panels are side panels, and said fourth panel is a rear panel.

11. The blank of claim 1 made of paperboard.

12. The blank according to claim 1 wherein said cut does not extend along said scoreline.

13. The blank according to claim 12 comprising a first flap separated from said first panel by said first scoreline, said cut extending within said first flap.

14. An erected shipping case having a top and a bottom comprising a first panel made from corrugated paper having a column formed from a flute, said panel having a top disposed adjacent the top of said shipping case and a bottom disposed adjacent the bottom of said shipping case, a scoreline substantially perpendicular to said flute at the bottom of said panel, and one or more cuts at said scoreline and said flute at least at one side of the panel to improve compressive strength thereof, said cut or cuts extending outside of said scoreline, said scoreline being not otherwise perforated.

15. The shipping case of claim 14 wherein said first panel further comprises lines of weakness defining, at least in part, a tear out section.

16. The shipping case of claim 15 wherein said first panel comprises a plurality of flutes having cuts to improve their compressive strength.

17. The shipping case of claim 16 wherein said first panel is a front panel.

18. The shipping case of claim 15 further comprising a first flap separated from said first panel by a first scoreline, said lines of weakness intersecting said first scoreline, and said cut occurring where said lines of weakness and said first scoreline intersect, said flap being folded at said scoreline.

19. The shipping case of claim 18 further comprising a second flap separated from said first panel by a second scoreline on a side of said first panel opposite said first flap, said second flap having two ends perpendicular to said second scoreline, said lines of weakness extending from said second scoreline at said ends of said second flap to said first scoreline.

20. The shipping case of claim 19 further comprising second and third panels on opposite sides of said front panel and separated therefrom by first and second panel scorelines, said second and third panels being side panels, said panel scorelines being perpendicular to said first and second scorelines, and a fourth panel separated from one of said side panels by a third panel scoreline disposed perpendicularly to said first and second scorelines.

21. The shipping case of claim 20 wherein said second and third panels each include second and third side panel first and second flaps separated from said second and third panels by side panel flap scorelines perpendicular to the second and third panel scorelines.

22. The shipping case of claim 21 wherein said second flap of said first panel comprises a third end parallel to the scoreline separating said first panel from said second flap, said second flaps of said second and third side panels each including lines of weakness aligned with said third end.

23. The shipping case of claim 22 wherein said first panel is a front panel, said second and third panels are side panels, and said fourth panel is a rear panel.

24. The case of claim 14 made of paperboard.

25. The shipping case according to claim 14 wherein said cut does not extend along said scoreline.

26. The shipping case according to claim 25 further comprising a first flap separated from said first panel by said first scoreline, said cut extending along said first flap.

27. A shipping case blank comprising a front panel, first and second side panels on opposite sides thereof, and a rear panel attached to one of said side panels, top flaps extending from the top of each of said front, side and rear panels, said front panel including two upper corners, said front panel including lines of weakness extending from each of said upper corners to a scoreline defining the bottom of the front panel, said top flap of said front panel including a free edge parallel to said bottom panel scoreline, said first and second side panel top flaps being separated from said first and second side panels by scorelines and each having a free edge on a side opposite said scoreline, said first and second side panel top flaps having lines of weakness which are disposed so as to be in alignment with said front panel top flap free edge when said case is erected and which extend from said side panel top flap free edges to said separating scorelines.

28. A shipping case comprising a front panel, first and second side panels on opposite sides thereof, and a rear panel attached to one of said side panels, top flaps extending from the top of each of said front, side and rear panels, said front panel including two upper corners, said front panel including lines of weakness extending from each of said upper corners to a scoreline defining the bottom of the front panel, said top flap of said front panel including a free edge parallel to said bottom panel scoreline, said first and second side panel top flaps having lines of weakness which are disposed so as to be in alignment with said front panel top flap free edge which first and second side panel top flap lines of weakness extend from a free edge thereof to a scoreline separating said flaps from said panels.

* * * * *